US005125640A

United States Patent [19]

Yerly et al.

[11] Patent Number: 5,125,640

[45] Date of Patent: Jun. 30, 1992

[54] GRIPPER BAR FOR GRIPPING SHEET-LIKE MATERIAL WITHIN A MACHINE TO BE USED FOR PRODUCING PACKAGES

[75] Inventors: Marcel Yerly, Jouxtens; Mauro Chiari, Lausanne, both of Switzerland

[73] Assignee: Bobst SA, Switzerland

[21] Appl. No.: 673,537

[22] Filed: Mar. 22, 1991

[30] Foreign Application Priority Data

Mar. 24, 1990 [CH] Switzerland ..... 00979/90

[51] Int. Cl.[5] ..... B65H 25/04

[52] U.S. Cl. ..... 271/204; 198/803.8

[58] Field of Search ..... 198/803.8; 271/277, 271/204, 205, 206, 82, 85

[56] References Cited

U.S. PATENT DOCUMENTS

| | | | |
|---|---|---|---|
| 2,418,065 | 9/1941 | Bobst | 271/204 X |
| 2,867,275 | 1/1959 | Laufer | 271/204 X |
| 3,960,264 | 6/1976 | Carbine et al. | 271/104 X |
| 4,526,100 | 7/1985 | Brasa | 271/204 X |
| 4,629,176 | 12/1986 | Ceelen | 271/204 |

FOREIGN PATENT DOCUMENTS

| | | | |
|---|---|---|---|
| 2520231 | 11/1976 | Fed. Rep. of Germany . | |
| 883780 | 7/1943 | France . | |
| 1178295 | 5/1959 | France . | |
| 0791559 | 3/1958 | United Kingdom | 271/204 |
| 0895640 | 5/1962 | United Kingdom | 271/106 |
| 1003838 | 9/1965 | United Kingdom . | |

*Primary Examiner*—Robert P. Olszewski
*Assistant Examiner*—Cheryl L. Gastineau

[57] ABSTRACT

A gripper bar fitted on drive chains and destined to grip and carry plate shaped sheets of material through printing, cutting and similar machines to produce a package characterized by the bar including a hollow profile on which the grippers are fastened. Every gripper consists of a flat spring attached at one end to a leading edge wall of the bar and having the other free end taking a rest position engaging a gripper counterpart which is situated on the trailing edge of the bar. The flat spring has a length greater than the width of the bar and passes through the bar before reappearing through a window on the trailing edge of the bar.

19 Claims, 4 Drawing Sheets

GRIPPER BAR FOR GRIPPING SHEET-LIKE MATERIAL WITHIN A MACHINE TO BE USED FOR PRODUCING PACKAGES

BACKGROUND OF THE INVENTION

The present invention is concerned with gripper bars which are used in a machine for converting plate-shaped matter or sheets into packages and enables the pulling and positioning of the sheets as they are carried through various sequence of printing, cutting, embossing, creasing and/or waste-stripping stations.

Gripper bars are generally fitted on two lateral chains at regular distances and extend crosswise to the travelling direction of the plate-shaped sheets. Inside the machine, the chains having the bars follow a circuit initially composed by successive horizontal translational movement from a starting position along a horizontal path through the various processing stations and then, at the end of the path, move in an upward arc to a return path which then terminates in a downward curved arc to the starting position for the path extending through the stations. When the bar is in the starting position, it is aligned with stops of a feeder table. At this stage, the grippers are opened by a control device which, depending on the structure of the machine, can be either an integral part of the gripper bar or a separate element of the machine.

When a subsequent piece of a sheet of material is pushed onto the feeder table toward the front stops with the leading edge being moved between the lower gripper counterparts and the upper pressing fingers of the open grippers, the gripper opening mechanism will then be actuated in a reverse direction in such a way that the new plate-shaped piece will be gripped in order to be carried to the first processing station in the course of the first translational movement of the gripper bar along the path between the stations. In view of the fact that in every processing station the plate-shaped pieces are to be stopped in order to allow the accomplishment of the corresponding cutting, waste-stripping and similar operations, the pieces are to be transferred from one station to the other as commanded by the successive translation composed of a combination of an acceleration, a deceleration, and either a dwell or a standstill.

Research, which was undertaken with the purpose of increasing in the production speeds of the machines, has shown the necessity to have the above-mentioned successive translations be accomplished with increasingly higher speeds in an increasingly shorter time rate of the operating cycle. So, for instance, it is possible to reach a throughput and production speed of more that 9,000 pieces per hour with a cycle duration of about 0.4 seconds, of which about 0.3 seconds are absorbed alone by the translation of the plate-shaped sheet through the station with a length of about 1 meter. Since the bars are connected only at their ends, the bending and torsional stresses applied to the bars by the acceleration and deceleration is readily evident.

Furthermore, these gripper bars should have sufficient sturdiness to prevent any deformation when the gripper opening axle, which may be part of the bar, is driven in a rotary direction contrary to the numerous springs which guarantee the closing of the grippers. On account of the small size of the grippers fitted along the trailing edge of the bar, the rear springs ensure their closing can only be shorter and stronger enabling them thereby to ensure the necessary gripping action for picking up the plate-shaped sheet of material. Consequently, a very strong opening torque is applied to the axle, which actuates the upper pressing fingers. Moreover, as the grippers are permanently fitted on the opening axle, this axle must be made from steel with appropriately large dimensions.

When taking into consideration the above-mentioned stresses, the bar is presently made from a more or less rectangular tube of an appropriate size. Similarly, the bar fixtures on the chains are to have adequate dimensions. Such a gripper bar is described, for instance, in French Patent 11 78 295. The bars of the French Patent have the drawback because their weight acts on the machine production speed. In fact, the movable assembly comprising the gripper bars, the pertaining fixtures and the two lateral chains on which they are fitted represent a mass of high inertia momentum of which any acceleration are contained between limits set by the resistance of gripper bar drive elements to the stresses resulting from the acceleration and, likewise, by the power of the main motor.

In order to enable the reduction of the gripper bar height, French Patent 88 37 80 proposes to have the full rectangular profile bar machined with recesses to allow a fitting of the elastic pivoting gripper on the leading edge of the bar in such a way as to prevent the gripper in the rest position from exceeding the upper and lower sides of the bar. However, such recesses or slots, which are made perpendicular to the lengthwise direction of the bar, greatly weaken the resistance of the bar to bending and torsion.

With this design, the height of these bars determine actually the minimum vertical shift to be effected by the lower movable platen when the plate-shaped sheets are being carried from one station to the other by these bars. In order to reduce the shifting range to a minimum with a view to increase the production speed, it is appropriate to have the movable platen accomplish the shortest shift possible. Consequently, the height of the gripper bar has to be reduced to a minimum, for example to the height of the gripper bar chains. Moreover, as the grippers are presently made entirely of metal, the clanking noise originating from their opening and closing action causes a considerable noise level which should be eliminated, if possible. Finally, such bars are generally connected at both ends to two laterally movable drive chains by means of so-called "floating" fixtures so that the plate-shaped material can be accurately positioned and aligned on the feeder table with regard to the travelling direction and to the processing station. Such "floating" devices are described, for example, in DE-C 25 20 231 and generally include a connection device engaged at one end of the gripper bar and elastically attached to the corresponding lateral drive chains. However, this connection has been conceived in such a way that every drive chain will have to be moved apart crosswise in order to disengage the bar end of the corresponding connecting device. Such "floating " fixtures of the prior art have, thus, the drawback of needing the dismantling of the drive chain from the machine, for instance in cases where a gripper bar would have to be exchanged. Such fixtures are generally of heavy weight, of difficult execution and are, thus, expensive. In addition, as disclosed in GB-A 10 03 838, the "floating" fixture includes a connection device fitted on the bar on a special link of the drive chain. The connection device is provided with two arms held in place on the outer surface of the lower and upper walls of the bar, as well as with two male and female knuckles; one close to the leading edge and the other to the trailing edge of the bar. The special link is provided with a male knuckle. The male and female knuckles are connected to one another by means of two rods extending across corresponding holes; the male knuckle being fitted on the rod so as to enable a slight shift with an elastic catch-up in the travelling direction of the drive chains. A relevant fact is that with this connection device, the height of the two arms is to be added to the one of the bar.

SUMMARY OF THE INVENTION

An object of the present invention provides a gripper bar, whose weight and vertical dimensions will be reduced to a minimum, but also has the rigidity and gripping force for resisting stresses and forces appearing during the press run. The gripper bar is also provided with a fixture on the drive chain, which should be, on the one hand, of a simple and light design and, on the other hand, allows easy fitting and dismantling of the bar from the two lateral drive chains.

In addition, the associated gripper opening device should also be of a lighter weight and necessitate a lesser opening effort besides ensuring simultaneous maximum opening of all grippers. In addition, a gripper bar of the present inventions enables a reduction in the manufacturing and maintenance cost as well as a considerable reduction in the noise level caused by the bar in the various processing stations.

To obtain these objects, the present invention is directed to an improvement in a gripper bar for gripping plate-shaped matter to be used in printing, cutting, embossing and creasing machines for the production of packages, said gripper bar comprising a profile hollow bar with an upper wall, a lower wall, a leading edge and a trailing edge, said grippers being arranged at regular distance along the bar and consisting each of an upper finger with the shape of a resilient plate attached at one end to the leading edge wall of the bar and a gripper counterpart situated on a trailing edge wall of the bar, the bar being connected at both ends to two lateral conveyor changes. The improvements are that each of the resilient plates has a length exceeding the width of the bar and the plate crosses through an interior of the bar and extends through an opening or window in the trailing edge wall of the bar.

Other advantages and features of the invention will be readily apparent from the following description of the preferred embodiments, the drawings and claims.

DESCRIPTION OF THE PREFERRED EMBODIMENTS

The principles of the present invention are particularly useful when incorporated in a gripper bar 100 (see FIG. 2) which is attached at each end to a drive chain 90.

Figure 1:
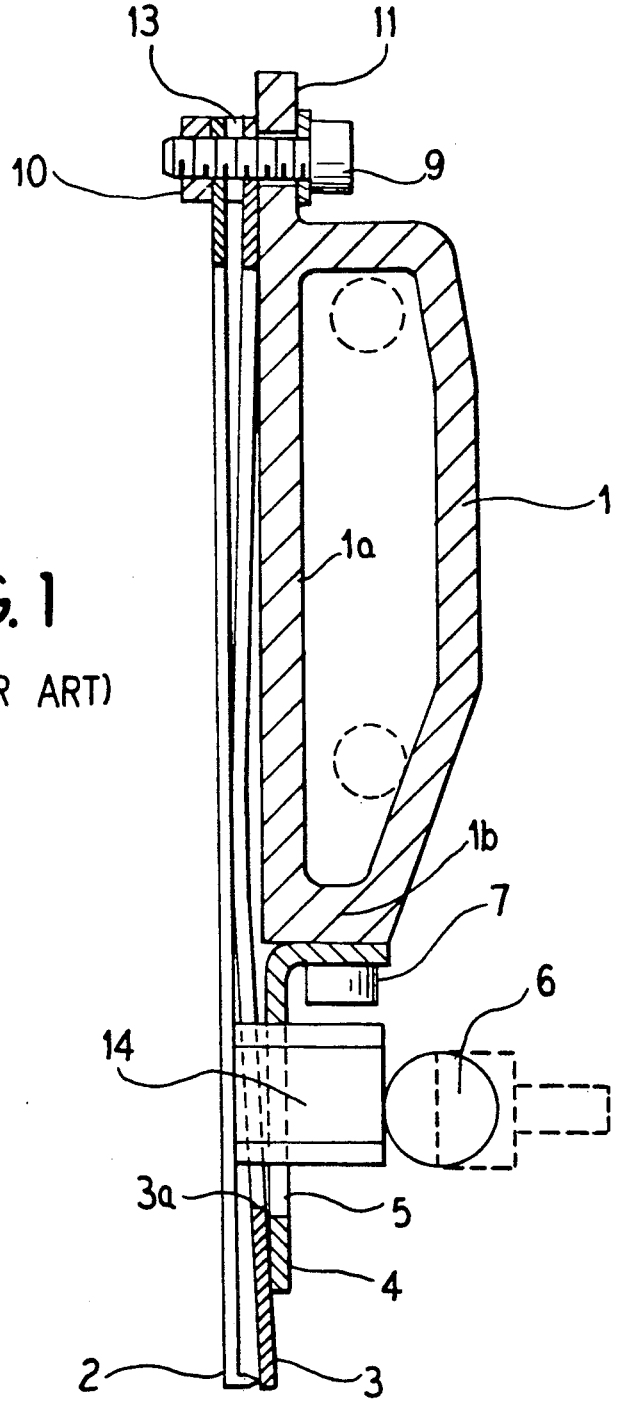
FIG. 1 (PRIOR ART)
FIG. 1 is a cross sectional view of a known gripper bar of the prior art.

In FIG. 1, a previously known gripper bar 1 is illustrated and consists of a hollow, hexagonal profiled piece 1 which has an extension 11 on a leading edge wall adjacent an upper wall 1*a* of the bar. A trailing edge 1*b* of the bar has a right angled member 4 secured by means of a screw so that the member 4 extends rearwardly from the trailing edge 1*b*. Two elastic lamellae 2 and 3 are secured to the extension 11 by means of a screw 9 and a nut 10 with a spacer 13 extending therebetween. As mounted on the bar 1, the two elastic lamellae or parts 2 and 3 extend from the leading edge of the bar along the upper wall 1*a* past the trailing edge formed by the right angled member 4. The part of lamellae 2 forms a gripper, while the lamellae or part 3 forms a counterpart. The gripper or part 2 is provided with a tenon 14 which extends through an aperture 3*a* in the counterpart 2 and a aperture 5 in the member 4. A control organ or element 6, which is part of the machine, is in contact with the tenon 14 and is designed for opening the gripper 2. As may be gathered from FIG. 1, the gripper 2 and the gripper counterpart 3 consist of two elastic lamellae situated along the top wall 1*a* of the profiled piece 1 and involve an increase in the overall height of the gripper bar with the above-mentioned drawbacks.

Figure 2:
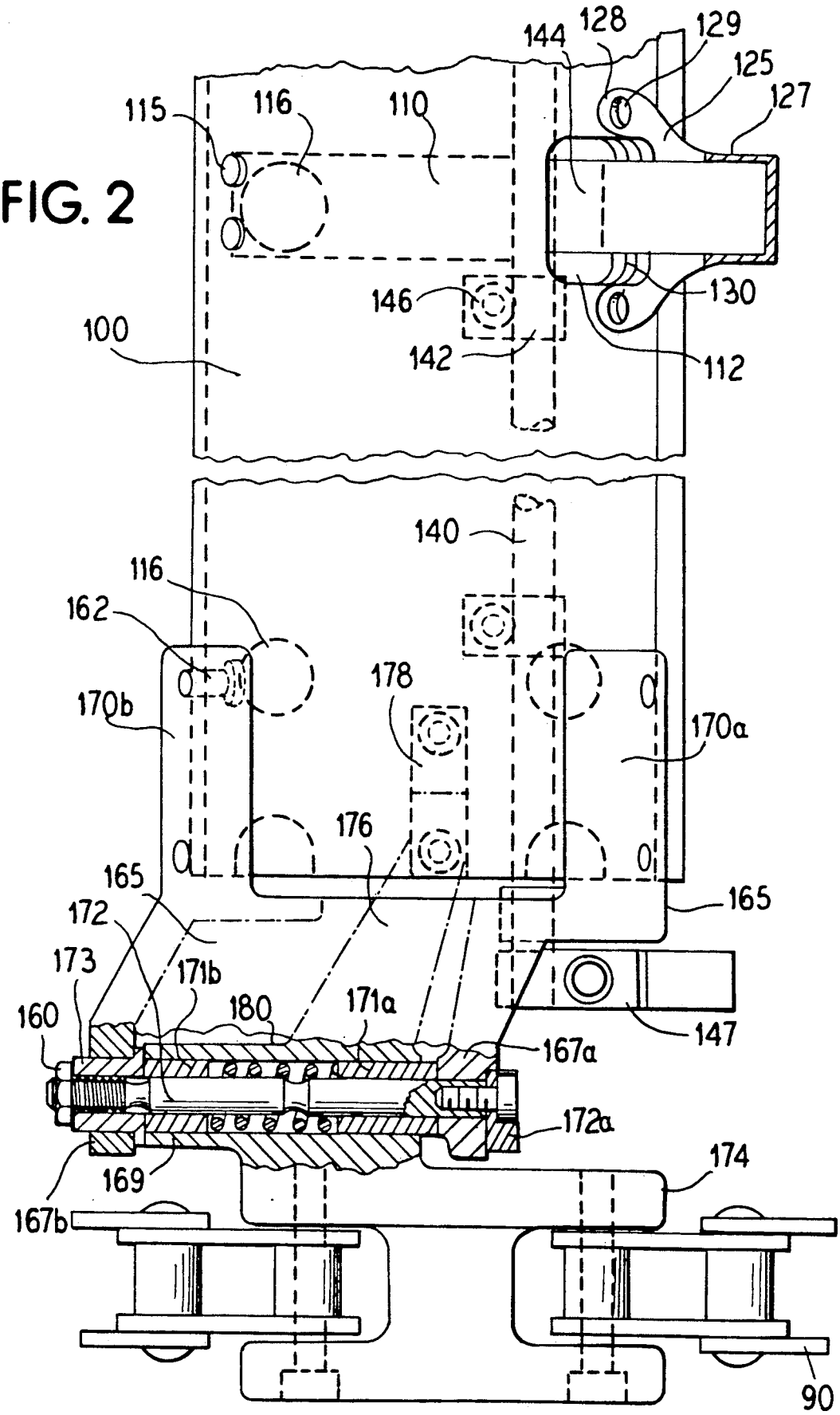
FIG. 2 is a partial top plan view with portions broken away for purposes of illustration of a gripper bar according to the present invention attached at one end to a chain.
Figure 3:
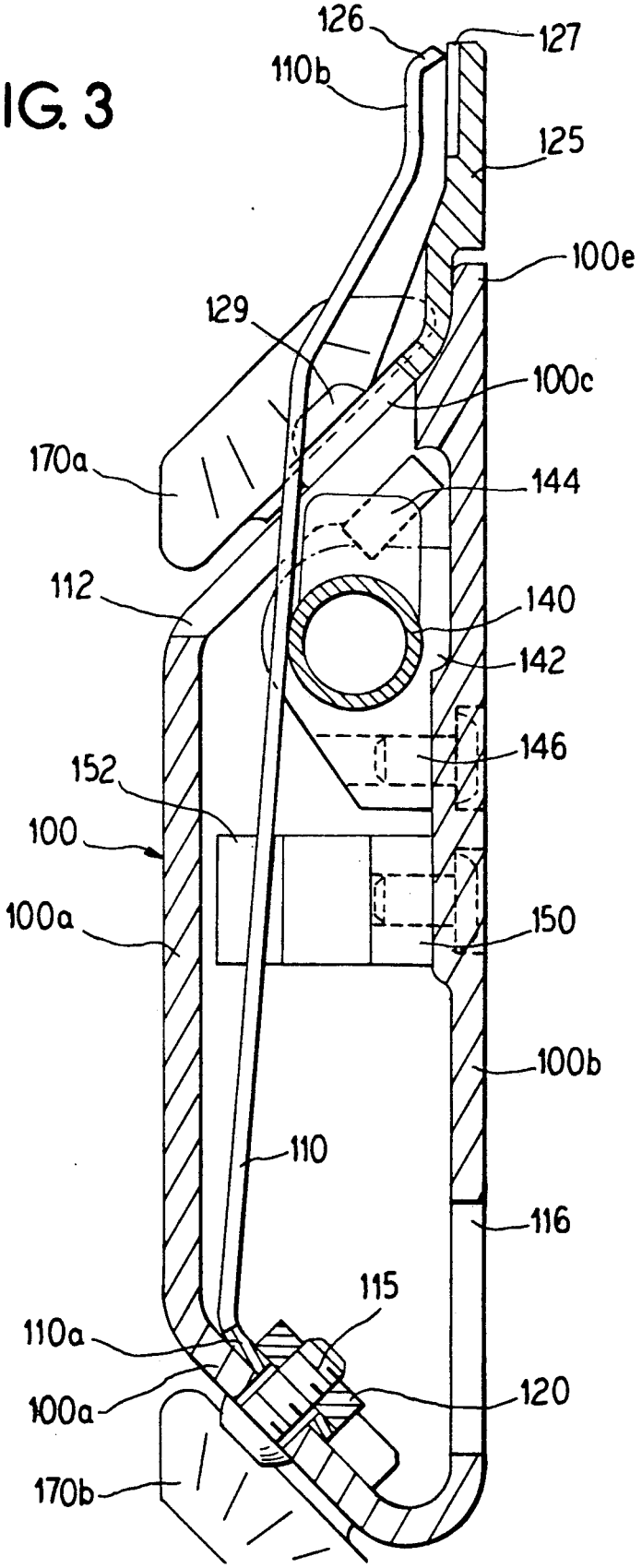
FIG. 3 is a cross sectional view taken along the line 11—11 of FIG. 2.

According to the first embodiment of the invention, as illustrated in FIGS. 2 and 3, the gripper bar 100 has grippers which include an upper finger 110 and a gripper counterpart 125. In addition, a gripper opening axle 140 and two fixtures 165 and 169 are arranged at either end of the bar 100 to, thus, allow the bar to be fitted on or attached to a lateral chain, such as 90.

The bar 100 has a hollow profile and is made of aluminum, magnesium or a composite material. In a crosswise section, illustrated in FIG. 3, the bar has a profile of a trapezoid with an upper wall 100*a*, a lower wall 100*b*, which is connected to the upper wall along the leading edge by a leading edge wall 100*d* that forms an angle of approximately 45° to both the wall 100*b* and the wall 100*a*. A trailing edge wall 100*c* extends from the upper wall 100*a* to the lower wall 100*b* and terminates in a trailing edge extension or tongue 100*e* that extends substantially parallel with the lower wall 100*b*. The walls, such as 100*a*, 100*b* and 100*d*, all have a constant thickness of approximately 3 mm, except for two thicker areas, which extend inward from the outer surface. One of these thicker areas is on the lower wall 100*b* and is close to a center line, and the other one is in the lower corner of the trailing edge wall 100*c*. These thickened areas ultimately become the seats of fastening screws for complementary elements. The tongue or extension 100*e* extends over the length of the bar 100. Moreover, the trailing edge 100*c* of the bar 100 contains windows or openings 112 at regular spacing along the length of the bar, while the leading edge of the lower wall 100*b* has circular access apertures 116 corresponding to and aligned with the windows or apertures 112.

As illustrated in FIG. 2, the gripper counterpart 125 is secured by screws 129 and extends through apertures in ears 128 of the counterpart 125. As illustrated, the ears 128 extend on both sides of the window 122 with the majority of the counterpart being below the window 112 and resting on the tongue or extension 100*e*. The screws, such as 129, are threaded bores formed in the thickened portion of the trailing edge wall 100*c*. Every gripper counterpart 125 has the shape of a plate consisting of two wings sloped with regard to one another. For example, one of the wings extend substantially along an upper surface of the tongue 100*e*. The other wing 128 will slope at an angle of approximately 45° with regard to the first-mentioned wing and contacts the outer surface of the trailing edge wall 100*c*. The particular fork-like shape of the gripper bar counterpart 125 is obtained by die-stamping or molding. This shape is such as to allow every gripper counterpart 125, once in place, to be supported by the lengthwise tongue 100*e*. The flat horizontal portion or leg of the gripper part 125 has a width of about 20 mm and its outer edge is covered by an elastomeric tape 127, which is either vulcanized or glued thereon. Moreover, the active surface formed by the tape 127 of the gripper counterpart is situated on a horizontal extension of the lower wall 100*b* of the bar 100. Any specialist will easily become aware that in cases where it is useful to operate without a gripper margin on the sheet front edge, the gripper and the gripper counterpart can be easily and quickly removed from the gripper bar.

Every gripper is actually a flat steel spring 110, the length, width and thickness of the spring is equal to about 120 mm, 20 mm and 1.2 mm. The spring 110 is bent at approximately 60° at a first or so-called fastening end 110*a*. At the other end, which is the supporting end 110*b*, the spring 110 is curved or bent at two spaced portions by about 30° to provide a straightened portion that extends substantially parallel to the active surface 127 of the counterpart 125. The very tip of the spring is bent to form a tooth or biting portion that coacts with the active surface 127. This flat spring 110 is mounted on an inner wall surface of the leading wall portion 100*d* of the bar 10 by means of a threaded fastener 115 coacting with a nut 120. As illustrated, this nut 120 is disposed in the interior of the bar and access to the nut is gained through the opening, such as 116. As illustrated in FIG. 3, the flat spring 110 is connected to the leading wall 100*d* at one end and has its free end extending through the opening 112 with the tip 126 resting on the active surface 127 of the gripper counterpart 125. The tip of supporting end 126 of the spring 110 is machined to form a succession of teeth or a cutting edge. Considering the particular shape, the flat spring 110 provided by the above-mentioned bend and the teeth formed on the end 126 will press with a certain force onto the active surface 127 of the gripper counterpart 125 when the assembly of the screw 115 and nut 120 is tightened in order to fix the position of the spring 110. The assembly consisting of the teeth on the end 126 and the elastomeric layer 127, thus, greatly increases the strength with which the plate-shaped matter or sheet is to be gripped by the gripper bar.

In the embodiment of the gripper bar 100 of FIGS. 2 and 3, the bar is provided with a device for simultaneously opening all of the grippers. This opening device includes an axle 140 extending along the axis of the bar and supported by bearing members 142 above an inner surface of the lower wall 100*b* of the bar 100. As viewed in FIG. 3, this axle 140 is positioned in the quarter of the bar adjacent the trailing or rear wall 100*c* just above the lower wall 100*b*. Preferably, the axle 140 is made of a thin wall aluminum anodized hollow tube with a diameter of about 10 mm. The bearing shells 142 are all made of synthetic resin and are held in place by screws 146 of which the head is countersunk into a seat especially added to the thicker area of the lower wall 100*b*. The friction coefficient between the axle 140 and the bearing shells of synthetic resin is very low and the axle 140 can rotate easily within the shells 142. This solution allows for eliminating the expensive ball-bearings including their lubrication. Thus, the manufacturing and maintenance costs for the bar are reduced.

As may be seen more clearly from FIG. 3, the axle 140 extends beneath and along the flat springs 110. A cam 144 is appropriately arranged by either gluing or splinting on a trailing side of the axle 140 to extend beneath each of the flat springs. These cams 144 have an axial length along the axis of the axle 140 which is practically equal to the width of the flat spring, for example 20 mm, and the cams have a generally square cross section with rounded edges, except at the left-hand end, as illustrated in FIG. 3, which engages the axle 140 and has a concave circular configuration corresponding to the configuration of the axle. In view of the considerable contact surface between the cam 144 and the axle 140, the cam 144 can be simply arranged on the axle by gluing or splinting. However, the length and the shape and position of the cam 144 with regard to the flat spring 110 can be chosen in such a way as to limit the torque throughout the whole gripper opening action to a minimum amount. This limitation is obtain, as shown by FIG. 3, by the fact that with the cam 144 rotating, the length of the lever ensures the opening torque diminishes progressively in order to compensate for the increase of the respective strength of the spring 110.

As shown by FIG. 2, the axle 140 emerges from the hollow bar 100. Every end of the axle 140 is provided with a lever 147. In this way, with the gripper bar 100 reaching the level of the guiding stops of the feeding table, an appropriate means (not illustrated) can rise adjacent the trailing edge of the lever 147 in order to turn the axle 140 counter-clockwise through an angle equal to about 33° in such a way as to cause the rising of the supporting ends of the flat spring 110 to a height of 6 mm by the action of the respective cams 144. The rising of the flat spring 110 by the cams 144 to the height is sufficient for the insertion of a standard plate-shaped sheet into the grippers. Consequently, the above-mentioned limitation of the gripper opening torque allows a reduction of the dimensions of the axle 140. Moreover, the cams 144 are not arranged along the trailing edge of the axle 140 according to a straight generatrix, but according to a slight helical generatrix in such a way that the grippers situated at the ends of the bar 100 will be opened first. This arrangement was selected in consideration of the torsion on the axle 140, which is but a hollow aluminum tube, during its rotation against the resistance of the flat springs 110. The part of the surface of the lever 147 entering into contact with the control means is protected by an elastomeric vulcanized or glued layer in order to eliminate the noise and to reduce the wear of the surfaces which are in contact with one another.

Appropriate shims, such as 105 (FIG. 3) can be secured by means of screws on the inside of the bar 100 along the center line of the lower wall 100*b*. The shims 150, which can be formed of cemented and hardened steel, will absorb the bending stresses acting on the gripper bar 100. As illustrated, the shim 150 has a groove 152 to allow passage of the flat spring 110.

the gripper bar 100 is connected at both of its ends to two drive chains, such as the drive chain 90 shown in the lower part of FIG. 2. This connection is by a so-called floating fixture or device which includes as fixture 165 provided with a leading edge arm 170*b* and a trailing edge arm 170*a*. The leading edge arm 170*b* and the trailing edge arm 170*a* have a shape assuming exactly the configuration of the outer surfaces of the leading edge wall 100*d* and the trailing edge wall 100*c*, respectively. The leading edge arm 170*b* is attached to the leading edge wall 100*b* by screws 162, which are inserted through the apertures 116 into the interior of the bar 100 to be threaded in to form the connection. In a similar manner, the trailing edge arms 170*a* are secured to the bar 100. The dimension and arrangement of the fastening arms 170*a* and 170*b* are determined in such a way that they will by no means increase the height of the gripper bar. The fixture 165 is also provided with a trailing edge knuckle 167*a* and a leading edge knuckle 167*b*.

This floating device, moreover, includes a male knuckle 169 which is part of a special link 174, which is secured to the drive chain 90. The male knuckle 169 and the female knuckles 167*a* and 167*b* are linked to one another by means of a rod-shaped axle 172 which extends through corresponding bores in the knuckles.

Inside the bore of the knuckle 169, the rod 172 is surrounded by two bushings 171*a* and 171*b* of synthetic resin and separated from one another by a spring 180. The first bushing 171*b*, which is situated in the leading edge, is glued on the inner surface of the bore, whereas the other bushing 171*a*, which is situated trailing the first bushing, may slide freely within th bore. Inside the bore of the upstream female knuckle 167*b*, the rod 172 is surrounded by a stop busing 173 acting jointly with a nut 160, which engages in a threading on the leading end of the rod 172. The trailing end of the rod 172 is provided with a headpiece 172*a* so that when the nut 160 is threaded on, the rod 172 will be fitted lengthwise with regard to the female knuckles 167*a* and 167*b*. On the other hand, a certain clearance is foreseen for the male knuckle 169 so that this knuckle may slide along the rod 172 against theresistance of the spring 180. As illustrated in FIG. 2, the male knuckle 169 is able to slide with the help of the synthetic bushing 171*a* on the rod 172 as the spring 180 urges the knuckle toward the leading edge knuckle 167*b*. Such a fastening device enables the interlocking of the gripper bar 100.

The male knuckle 169 is also provided with a supporting arm 176 which extends toward the hollow bar 100 and the end of which arm 176 penetrates into the hollow bar wher it is engaged with a free sliding motion in line with the gripper bar chain travelling direction in a hook 178 mounted on the inner surface of the lower wall 100*b* of the bar 100. The arm 176 is to prevent the rotation of the gripper bar around the rod 172.

Figure 4:
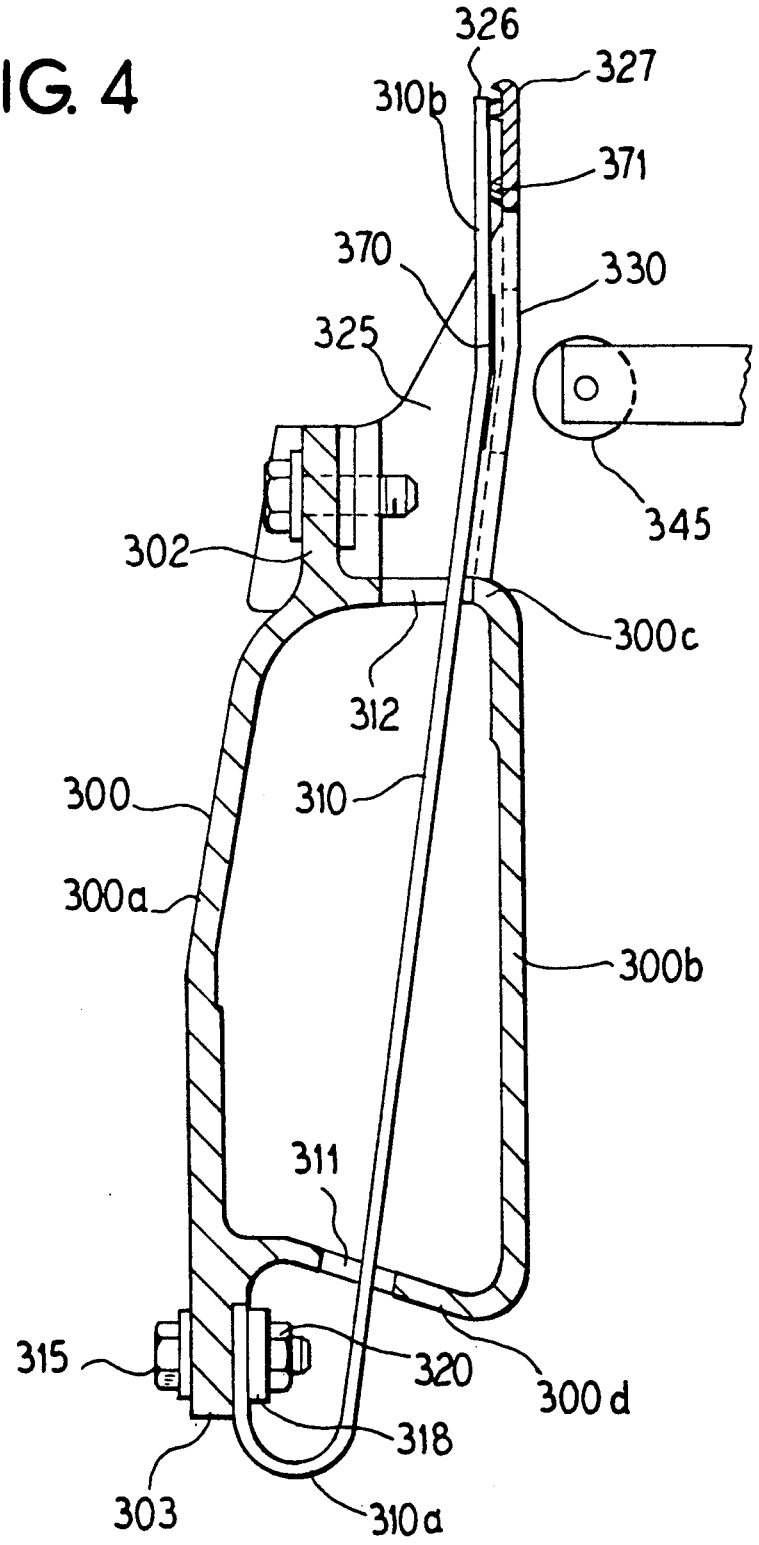
FIG. 4 is a cross sectional view similar to FIG. 3 of a modification of the gripper bar in accordance with the present invention.

A second embodiment of the gripper bar is illustrated in FIG. 4. In this embodiment, an upper finger of the gripper consists of flat spring 310 with a length larger than the width of the profiled hollow bar 300. However with this mode of construction, the profile of the bar 300 is essentially rectangular and has an upper wall 300*a*, a lower wall or bottom wall 300*b*, a trailing edge wall 300*c*and a leading edge wall 300*d*. However, this rectangular bar has two tongues 302 and 303. The tongue 302 extends in a trailing direction from the trailing edge wall 300*c* and the tongue 303 is a leading edge tongue extending from the upper wall 300*a* forward of the leading edge wall 300*d*. The trailing edge wall has rectangular window 312 whereas the leading edge wall 300*d*has openings or apertures 311.

The spring 310 has a leading end 310*a* which is bent into a U-shape with the free portion being secured to the tongue 303 by a threaded arrangement including a threaded member 315, a washer 318 and a nut 320. A gripper counterpart 325 is secured on a lower side of the tongue 302 adjacent the aperture 312 by a threaded fastener. The flat spring 310, at an end opposite the end 310*a*has a support end 310*b* which has a pointed tongue 326 that is bent downward. The tongue 326 engages an upper surface of the counterpart 325 which has two lengthwise extending salients.

In order to limit the movemnt range of the support end 310*b* of the flat spring 310 as well as to prevent wear down and noise resulting from the contact of the tongue 326 with the active surface 327 of the gripper counterpart 325, a dampening device 371 is provided on the counterpart 325 to engage the support end 310*b* of the flat spring. Thus, when the gripper closes the dampening device prevents the tongue 326 from coming into complete contact with the counterpart 325.

With this second embodiment of the gripper bar, the gripper opening device is positioned outside of the bar. Inside if the gripper part 325, a large aperture 330 is provided beneath the flat spring 310 which allows the entrance of a roller 345, which controls the opening of the gripper when moving upward with the help of means (not illustrated) which is driven by the machine. In order to limit the noise caused by the opening of these grippers, an elastomeric layer 370 can be vulcanized beneath the flat spring 310 in the area where the roller 345 will exert its pressure.

In the above description of th two embodiments, measurements for the thicknesses of various parts were given for the purpose of rendering the invention better understandable. It should be understood that these measurements are not limited and that these proportions are variable within the framework of the invention so as allowed to take into account the particularities of various machines or plate shaping sheets which are to be processed.

Although various minor modifications may be suggested by those versed in the art, it should be understood that we wish to embody within the scope of the patent granted hereon all such modifications as reasonnably and properly come within the scope of our contribution to the art.

We claim:

1. In a gripper bar for gripping a plate-shaped sheet to be used in printing, cutting, embossing and creasing machines for the production of packages, said gripper bar comprising a profile hollow bar with an upper wall, a lower wall, a leading edge wall and a trailing edge wall, grippers being arranged at regular distance along the bar and consisting each of an upper finger with the sape of a resilient plate attached at one end to the leading edge wall of the bar and with the other end coacting with a gripper counterpart mounted on the trailing edge wall of the bar, said bar being connected at both ends to two lateral conveyor chains with the improvements comprising each resilient plate having a length exceeding the width of the bar and extending through an interior of said bar before passing through a window on the trailing edge wall of the bar, each of the resilient plates having a fastened end which is bent in such a way as to allow it to be attached against an inner surface of the leading edge wall of said bar, and opening means having an axle extending lengthwise in th gripper bar with an end of the axle extending past the end of the gripper bar, each end of the axle being provided with a gripper opening lever engageable by the machine, said axle being mounted to rotate on bearings within said gripper bar and having cams disposed on a trailing edge of the axle acting on a side of the resilient plate in an area associated adjacent to the free end of said resilient plate so that rotation of th axle causes movement of the resilient plate to an open position.

2. In a gripper bar according to claim 1, wherein each resilient plate has a portion adjacent the free end bent to provide a portion extending substantially parallel to a lower wall of the bar and parallel to an active side of a gripper bar counterpart which extends substantially parallel to the lower wall, said free end of the resilient plate having a portion bent toward the active side and perpendicular to the parallel portion to from a gripping edge.

3. In a gripper bar according to claim 1 wherein the cams are mounted on the asle in such a way that the respective fastening points are along a helical path to compensate for a twist deformation of the axle during its gripping opening rotation.

4. In a gripper bar according to claim 3, wherein the shape and dimension of the arrangement of every cam with regard to the resilient plates have been designed in such a way that with the movement of the cam, the length of the lever incurred by the opening torque on the gripper progressively diminishes so as to compensate for the increase in the elasticity originating from the resilient plates and thus to limit the opening torque.

5. In a gripper bar according to claim 1, wherein the axle is a hollow tube of anodized aluminum.

6. In a gripper bar acording to claim 1, wherein the bearings and the opening cams are formed of syntetic resin and the cams are fitted on the axle by means of glue.

7. In a gripper bar according to claim 1, which includes means for absorbing noise, thrusts and wear being arranged between the free of the resilient plate and the gripper counter part.

8. In a gripper bar according to claim 1, wherein the free end of the resilient plate is bent approximately perpendicular to the active surface of the counter part to a form a flat and hard beak.

9. In a gripper bar according to claim 8, wherein the beak has a shape of a tooth.

10. In a gripper bar according to claim 1, wherein an elastomeric layer is provided on the active surface of the gripper counter part.

11. In a gripper bar according to claim 1, wherein each end of the bar is connected to special link of a lateral chain by means of an appropriate fixture means including at least one fixture provided with two fastening braces connected temporarily to the leading edge and trailing edge of the bar, both braces being designed to be able to adopt exactly the outer shape of th leading and trailing edges respectively without increasing the height of the gripper bar.

12. In a gripper bar according to claim 11, wherein said fixture is provided with two female knuckles situated on the leading and trailing edges of the bar, said special link is provided with a male knuckle, all three knuckles are connected to one another by means of a rod-shaped axle extending through bores provided in said knuckles, said male knuckle being fitted on the rod with an axial backlash designed for the interlocking of the gripper bar within a processing station, said male knuckle being provided with a supporting brace which has one end extending into the interior of the bar and sliding freely within a corresponding component mounted in said interior of the bar.

13. In a gripper bar according to claim 12, wherein the rod is surrounded by two plastic bushings received within the bore of the male knuckle, said two bushings being separated from one another by means of a spring, one of said bushings situated adjacent to the leading edge female knuckle being glued on the wall of the corresponding bore whereas the other bushing under load of the spring is urged against the trailing edge knuckle, the length of the male knuckle being less than the distance separating the two female knuckles in such a way as to enable the male knuckle to move axially on the rod to prevent axial backlash.

14. In a gripper bar for gripping a plate-shaped sheet to be used in printing cutting, embossing and creasing machines for the production of packages, said gripper bar comprising a profile hollow bar with an upper wall, a lower wall, a leading edge wall and a trailing edge wall, grippers being arranged at regular distance along the bar and consisting each of an upper finger with the shape of a resilient plate attatched at one end of the leading edge wall fo th bar and with the other end coacting with a gripper counterpart mounted ont eh trailing edge wall of the bar, said bar being connected at both ends to two lateral conveyor chains with the improvement comprising teh upper wall having a tongue extending forward from the leading edge wall, said resilient plate having a length extending the width of th bar and having a reverse bend of 180° with a portion being secured on said tongue and the remaining portion extending through the interior of the bar before passing through a window on the trailing edge wall of the bar.

15. In a gripper bar according to claim 14, wherein the opening of the gripper is obtained by an element connected to the machine, said gripper counterpart being provided with an aperture situated between the trailing edge wall of the bar and an active surface of the counter gripper part, each individual gripper opening element passing through said aperture to engage and lift the resilient plate to the open position.

16. In a gripper bar according to claim 14, wherein an active surface of the gripper counter part is provided with at least one tooth.

17. In a gripper bar for gripping a plate-shaped sheet to be used in printing, cutting, embossing and creasing machines for the production of packages having two lateral conveyor chains, said gripper bar comprising a profile hollow bar with an upper wall, a leading edge wall and a trailing edge wall, grippers being arranged at regular distance along the bar and consisting each of an upper finger with the shape of a resilient plate attached at one end to the leading edge wall of the bar and with the other end coacting with a gripper counterpart mounted on the trailing edge wall of the bar, with the improvements comprising each resilient plate having a length exceeding the width of the bar and extending through an interior of said bar before passing through a window on the trailing edge wall of the bar, each end of the bar being connected to a special link of the lateral conveyor chain by means of an appropriate fixture means including at least one fixture being provided with two fatening braces connected temporarily to the leading edge and trailing edge of the bar, both braces being designed to be able to adopt exactly the outer shape of the leading and trailing edges respectively without increasing the height of the gripper bar.

18. In a gripper bar according to claim 17, wherein said fixture is provided with two female knuckles situated on the leading and trailing edges of the bar, said special link is provided with a male knuckle, all three knuckles are connected to one another by means of a rod shaped axle extending through bores providing in said knuckles, said male knuckle being fitted on the rod with an axial backlash designed for the interlocking of the gripper bar withina processing station, said male knuckle being provided with a supporting brace which has one end extending into the interior of the bar and sliding freely within a corresponding component mounted in said interior of the bar.

19. In a gripper bar according to claim 18, wherein the rod is surrounded by two plastic bushings received within the bore of the male knuckle, said two bushings being separated from one another by means of a spring, one of said bushings situated adjacent to the leading edge female knuckle being glued on the wall of the corresponding bore whereas teh other bushing under load of the spring is urged against the trailing edge knuckle, the length of th male knuckle being less than the distance separating the two female knuckles in such a way as to enable the male knuckle to move axially on the rod to prevent axially backlash.

* * * * *